United States Patent [19]

Bober

[11] Patent Number: 4,595,187

[45] Date of Patent: Jun. 17, 1986

[54] SADDLE STAPLER ACCESSORY

[75] Inventor: Henry T. Bober, Fairport, N.Y.

[73] Assignee: Xerox Corporation, Stamford, Conn.

[21] Appl. No.: 760,208

[22] Filed: Jul. 26, 1985

[51] Int. Cl.[4] ..... B41L 43/12

[52] U.S. Cl. ..... 270/37; 270/53; 493/454; 227/20

[58] Field of Search ..... 270/37, 53, 54; 227/20, 227/39; 493/442, 443, 454

[56] References Cited

U.S. PATENT DOCUMENTS

| | | | |
|---|---|---|---|
| 1,716,773 | 6/1929 | Greene et al. | 270/53 |
| 2,110,805 | 3/1938 | Lutolf | 270/53 |
| 2,119,511 | 6/1938 | Perkins | 270/53 |
| 2,709,584 | 5/1955 | Kleinberg | 270/53 |
| 2,895,730 | 7/1959 | Biel et al. | 270/37 |
| 3,915,445 | 10/1975 | Duncan et al. | 270/37 |
| 4,410,170 | 10/1983 | Wertheimer et al. | 270/37 |
| 4,497,478 | 2/1985 | Reschenhofer et al. | 270/53 |
| 4,519,599 | 5/1985 | Mayer | 270/53 |

*Primary Examiner*—E. M. Eickholt

*Attorney, Agent, or Firm*—William A. Henry, II

[57] ABSTRACT

A low cost, on-line saddle stapler accessory for preparing long edge fed booklets, receives side registered copies from a copier, and introduces a crease centrally of the copies. The copies are aided into a roof-shaped compiler tray and registered at their lead edges. When a set has been compiled, a first saddle staple is made and the set is passed on to a second position, registered and stapled a second time. Afterwards, the now saddle stapled booklet is forwarded to a stacking tray.

12 Claims, 7 Drawing Figures

SADDLE STAPLER ACCESSORY

This invention relates generally to a saddle stapler for use with an electrophotographic printing machine, and more particularly concerns an improved low cost, on-line saddle stapler for digests.

Many machines are available for collating or gathering printed sheets of material in order that they may be formed into booklets, pamphlets and the like, and such machines are now widely used in the production of forms, sales literature and instruction booklets. However, a problem with these machines is their bulkiness, complicated design and high cost. Accordingly, it is highly desirable to simplify this process of preparing saddle stitched output. The following disclosures appear relevant:

U.S. Pat. No. 2,709,584
Patentee: Kleinberg
Issued: May 31, 1955
U.S. Pat. No. 3,915,445
Patentee: Duncan et al.
Issued: Oct. 28, 1975
U.S. Pat. No. 4,410,170
Patentee: Wertheimer et al.
Issued: Oct. 18, 1983
U.S. Pat. No. 4,497,478
Patentee: Reschenhofer et al.
Issued: Feb. 5, 1985

The pertinent portions of these disclosures may be briefly summarized as follows:

Kleinberg discloses a signature gathering and stapling machine in which staples are used to staple already folded sheets located in each of a number of supply stations.

Duncan et al. discloses a method of an apparatus for forming a printed web into stitched signatures. The apparatus comprises a drum over the surface of which the webs pass. The drum has a central circumferential line of radially extending needles with bifurcated tips that have prongs spaced longitudinally of the drum.

Wertheimer et al. discloses a machine for stapling and folding a stack of paper to form a book. After laying a stack of paper down on trays against guide bars, staples are then applied.

Reschenhofer et al. discloses an apparatus for squaring, stapling and stacking copies. Normally, copies or copy sets are delivered from a copier and slide down a plate so that leading edges come to rest in an aligned position against a stop. A disk squares the stack and a stapler staples together the left hand edge of the stack.

In accordance with the present invention, a low cost, on-line saddle stapler is disclosed which prepares saddle stitched booklets and comprises a creasing roll that places a crease in the center of each sheet as it leaves the printing source. The thus weakened sheets are then forwarded into a roof shaped compiler tray and registered against a first registration gate which determines position of the first stitch. A saddle stitch is placed in the sheets, the registration gate lifted and the sheets are forwarded while still in the compiler tray to a second registration gate where a second saddle stitch is applied. Afterwards, the second registration gate is removed and the now saddle stitched booklet is forwarded from the compiler tray for further treatment.

While the present invention will hereinafter be described in connection with a preferred embodiment thereof, it will be understood that it is not intended to limit the invention to that embodiment. On the contrary, it is intended to cover all alternatives, modifications, and equivalents that may be included within the spirit and scope of the invention as defined by the appended claims.

For a general understanding of the features of the present invention, reference is made to the drawings. In the drawings, like reference numerals have been used throughout to designate identical elements.

Figure 1:
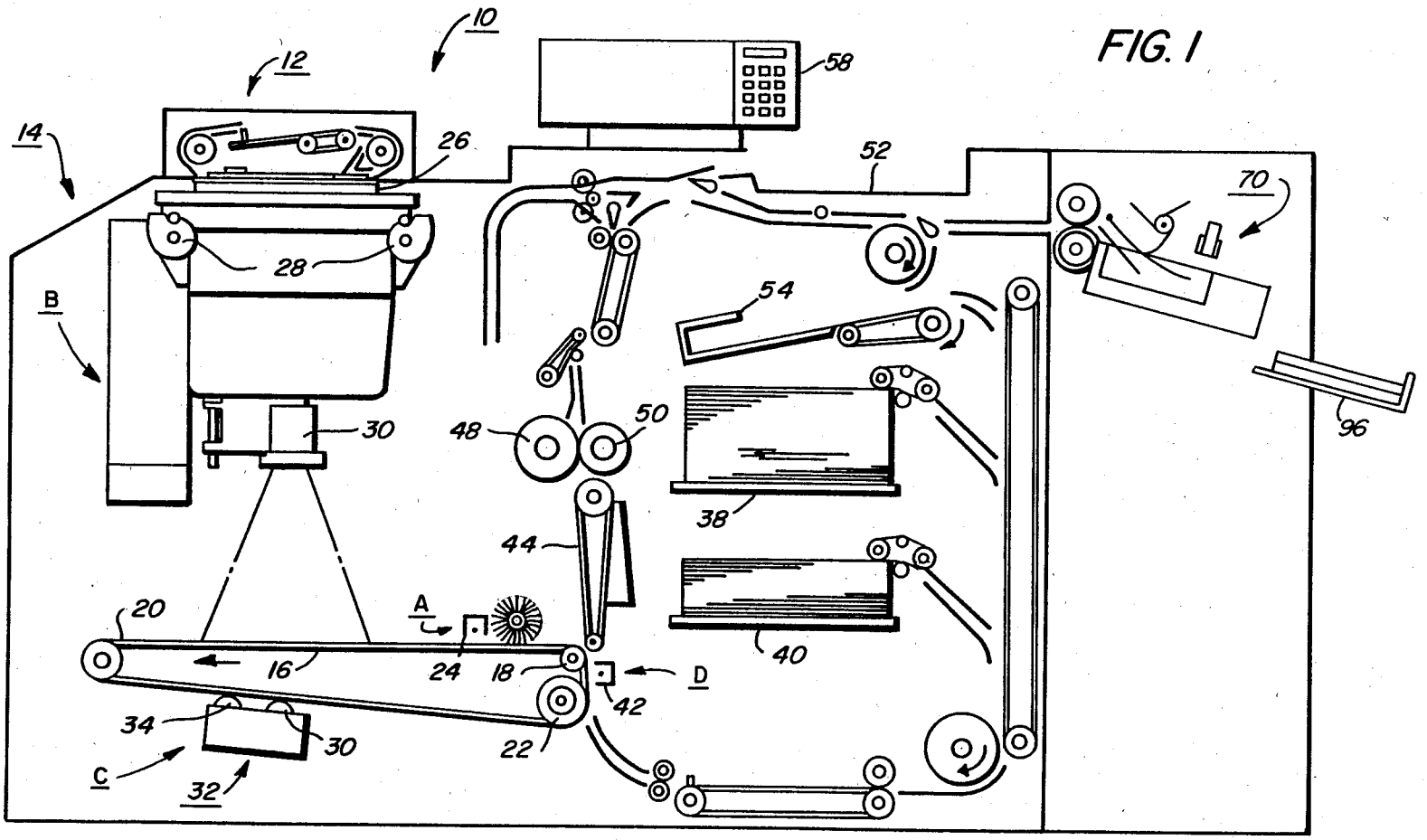
FIG. 1 is a schematic showing an electrophotographic machine feeding sheets to be stitched by the improved saddle stitcher of the present invention. However, it will become apparent from the following discussion that the present stitcher could be used to make booklets of sheets from any machine, and is not limited to the embodiment shown herein.

Turning now to FIG. 1, printing machine 10 includes conventional controller 58 and a recirculating document handling system 12 for advancing successive original documents onto the platen of the processing module 14. Inasmuch as the art of electrophotographic printing is well known, the operation of the various processing stations employed in processing module 14 will be described briefly.

Processing module 14 employs a belt 16 having a photoconductive surface deposed on a conductive substrate. Preferably the photoconductive surface is made from a selenium alloy with the conductive substrate being preferably made from an aluminum alloy which is electrically grounded. Belt 16 advances successive portions of the photoconductive surface sequentially through the various processing stations disposed about the path of movement thereof. Belt 16 is entrained about stripping roller 18, tensioning roller 20 and drive roller 22. Drive roller 22 is coupled to a suitable motor so as to rotate and advance belt 16.

Initially, a portion of belt 16 passes through charging station A. At charging station A, a corona generating device 24 charges the photoconductive surface of belt 16 to a relatively high, substantially uniform potential.

After the photoconductive surface of belt 16 is charged, the charged portion thereof is advanced through exposure station B. At exposure station B, and original document is advanced by the recirculating document handling system 12 to a transparent platen 26. Lamps 28 flash light rays onto the original document. The light rays reflected from the original document are transmitted through lens 30 forming a light image thereof. Lens 30 focuses the light image onto the charged portion of the photoconductive surface to selectively dissipate the charge thereon. This records an electrostatic image on the photoconductive surface of belt 16 which corresponds to the informational areas contained within the original document.

Thereafter, belt 16 advances the electrostatic latent image recorded on the photoconductive surface to development station C. At development station C a magnetic brush development system, indicated generally by the reference numeral 32, advances developer material into contact with the latent image. Preferably, magnetic brush development system 32 includes two magnetic brush developer rollers 34 and 36. Each roller advances developer material into contact with the latent image. These rollers form a brush of carrier granules and toner particles extending outwardly therefrom. The latent image attracts the toner particles from the carrier granules forming a toner powder image on the photoconductive surface of belt 16.

After the electrostatic latent image is developed, belt 16 advances the toner powder image to transfer station D. A sheet of support material is advanced to transfer station D from a copy sheet stack supporting apparatus 38 or 40. Transfer station D includes a corona generating device 42 which sprays ions onto the backside of the copy sheet. This attracts the toner powder image from the photoconductive surface to the copy sheet. After transfer, the copy sheet moves onto conveyer 44 which advances the sheet to fusing station E.

Fusing station E includes a fuser assembly, indicated generally by the reference numeral 46, which permanently affixes the transferred powder image to the copy sheet. Preferably, fuser assembly 46 comprises a heated fuser roller 48 and a back-up roller 50. The copy sheet passes between the fuser roller and back-up roller with the toner powder image contacting the fuser roller. In this manner, the toner powder image is permanently affixed to the copy sheet. After fusing, the copy sheet is either advanced to output tray 52, returned to duplex tray 54 for subsequent recycling so as to enable a toner powder image to be transferred to the other side thereof, or if stitching is required, directed into saddle stitcher 70 that is partially supported by castor mounted supports (not shown). The detailed structure of saddle stitcher 70 will be described hereinafter with reference to FIGS. 2–7.

Figure 2:
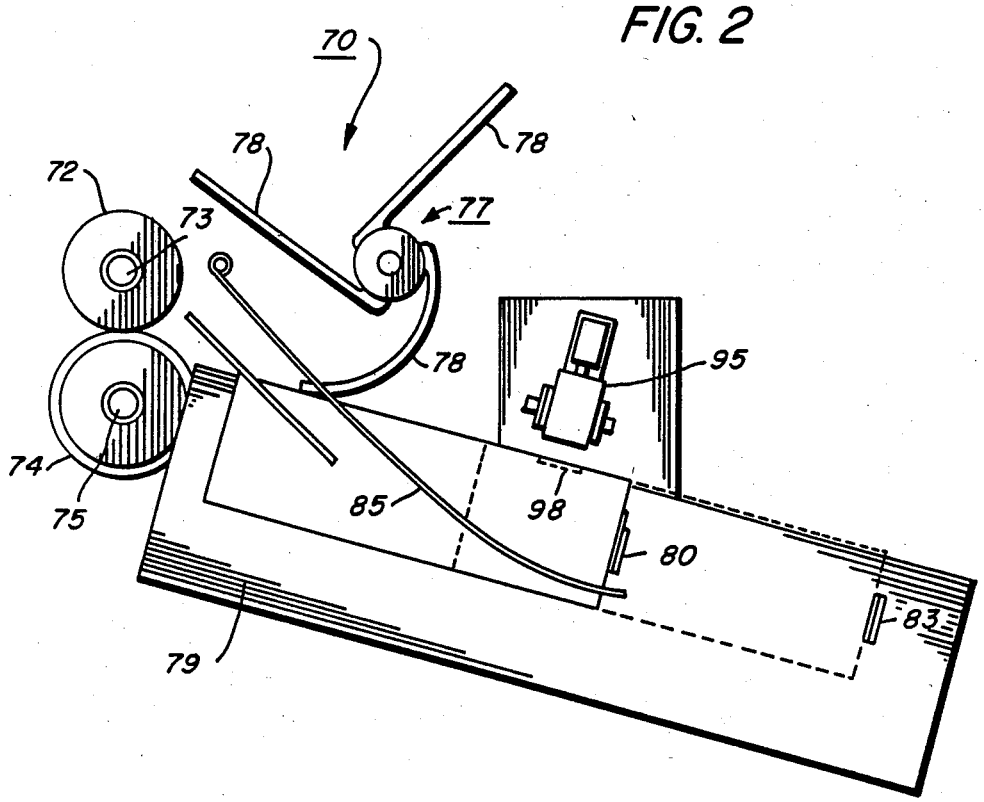
FIG. 2 is a partial elevational view of the saddle stapler in accordance with the present invention.
Figure 3:
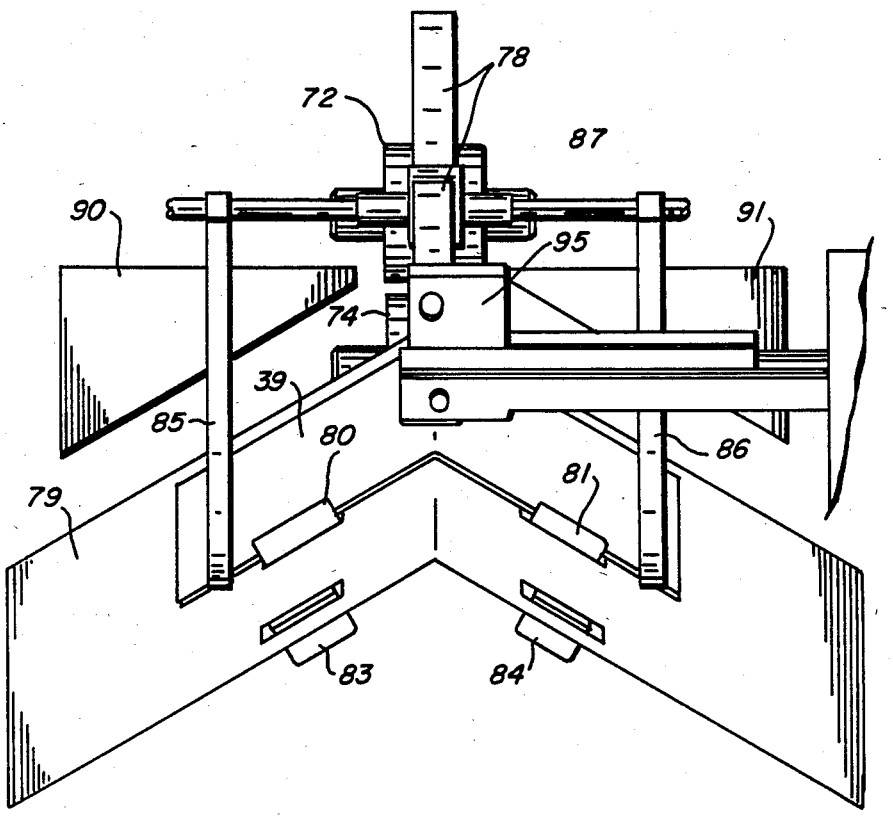
FIG. 3 is a partial plan view of the apparatus of FIG. 2.
Figure 4:
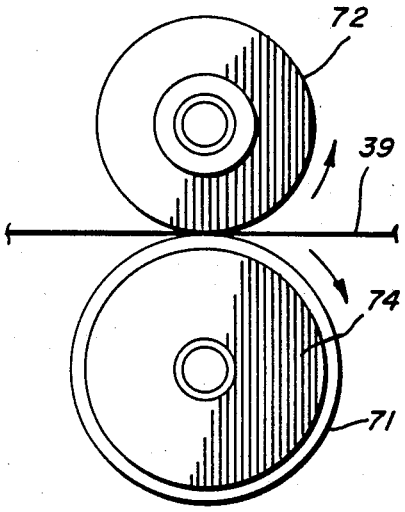
FIG. 4 is an exploded elevational view of the creasing rolls employed in the apparatus of FIG. 2.
Figure 5:
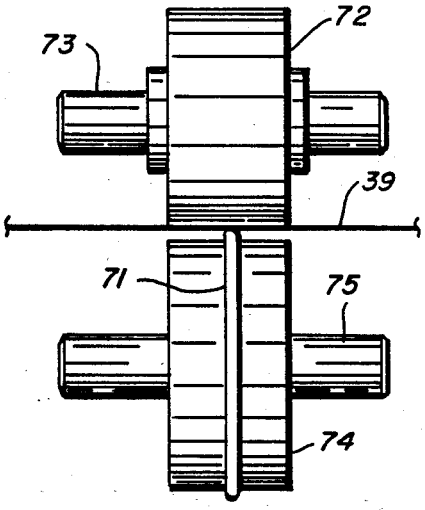
FIG. 5 is an exploded end view of the creasing rolls of FIG. 4.
Figure 6:
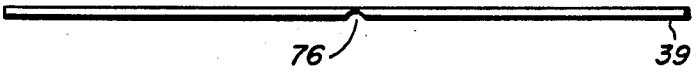
FIG. 6 is an exploded end view of a sheet after creasing by the creasing rolls of FIGS. 4 and 5.

Referring now to FIG. 2, there is shown a fragmentary elevational view illustrating the saddle stitcher of the present invention in greater detail. As depicted thereat, the on-line saddle stitcher 70 receives long edge fed copies from a copier/duplicator 10. Each copy as it enters creasing die roll pair 72, 74 is creased approximately 1/16" (1.5 mm) wide down the center of the copy as shown in FIG. 6 by the action of lower roll 74 acting on the underside of the sheet. As shown in FIGS. 4–6, creasing roll 74 is drivingly mounted on shaft 75 adjacent mating roll 72 that is mounted for rotation as an idler on shaft 73. The surface of roll 72 could be deformable to allow for minimal penetration of aluminum roll 74 with its protruding centrally located ridge 71 which places the crease in the copy sheet passing between the two rolls. This weakened area 76 of the sheets facilitates folding of the sheets onto "roof-shaped" compiler tray 79. The sheets are aided into compiler tray 79 by a light action/high speed, low normal force paddle wheel 77 whose paddles 78 strike the sheets as they are leaving the creasing rolls and propels them toward retractable registration gates 80 and 83. As shown in FIGS. 2 and 3, the weakened sheets are formed by fold forming baffles 90 and 91 and symmetrical control devices 85 and 86. Fold forming baffles 90 and 91 each have a surface adjacent compiler tray 79 that is at the same angle of slant as the tray and as a result sheets leaving the creasing rolls are guided into conforming in shape to that of the compiler tray. This guidance of the sheets toward the shape of the compiler tray is further enhanced by flexible control devices 85 and 86. The control devices are mounted on shaft 87 and come in contact with the sheets after they have been formed by baffles 90 and 91. The control devices insure that the sheets conform to the shape of compiler tray 79, i.e., the center of the sheets are centered on the peak of the compiler tray with the remainder of the sheets resting against the downward slanted portions of the compiler tray that extend down from the peak portion of the tray.

Figure 7:
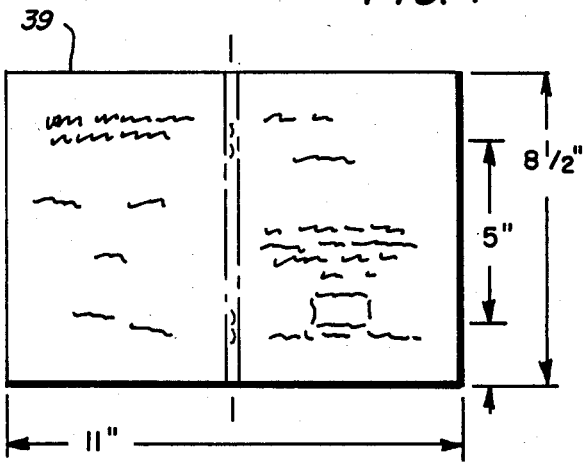
FIG. 7 is a plan (interior) view of a booklet saddle stitched with the apparatus of the present invention.

The compiler tray 79 is located at an angle of about 30° from a horizontal plane. With this angled positioning, the drive of the creasing roll and the force applied to the sheets by paddles 78, the sheets are registered on the tray against first registration gates 80 and 81 and centered on the peak of the "roof-shaped" tray. Registration gates 80 and 81 position the leading edge of each registered set about 1¾" (44 mm) beyond a repositionable saddle stapler 95 (e.g. a Swingline model 615 with a cam drive). Once the set is compiled, the stapler is actuated by controller 58 to engage passive clinch anvil 98 of the stapler and the first of two saddle staples is made. The passive anvil 98 is centrally located on and is an integrated part of the "roof-shaped" compiler tray 79. Registration gates 80 and 81 are then retracted allowing gravity and paddle wheel 77 to slide the book 5" down hill into second registration gates 83 and 84. The stapler is again actuated and thereby making the second staple. The second gates are then retracted allowing the flat open book, as shown in FIG. 7, to fall into output stacker 96.

It should now be apparent that a low cost, on-line accessory has been described for preparing saddle stitched booklets that includes an inverted V-shaped compiler tray. Sheets compiled into sets in the tray are first creased by creasing rolls and then forced to conform to the shape of the tray by forming baffles and flexible control devices as they are fed into the tray with the centers of the sheets being located on the pointed most portion of the tray. A paddle wheel and gravity assist in registering the compiled sheet sets against first registration gates where a staple is made. The first registration gates are removed to allow the set to register against second registration gates where another staple is made. Afterward, the stapled booklet is released for further processing. This device could take the form of a roll up option if such was desired.

What is claimed is:

1. A saddle stapler accessory for preparing booklets, comprising:

creasing rolls for applying a crease to incoming sheets;

a roof-shaped compiler tray for receiving the sheets and compiling the sheets into sets on a support surface thereof;

fold forming baffles configured in relation to said compiler tray to fold the sheets in the form of said support surface of said compiler tray;

a paddle wheel for driving the sheets into said compiler tray;

first and second registration gates for registering the sheets at predetermined positions;

control devices for guiding the sheets onto and centering the sheets on said support surface of said compiler tray; and a stapler for saddle stitching the sheets as a set at said first and second registration positions.

2. The saddle stapler accessory of claim 1, wherein said control devices are flexible strips.

3. The saddle stapler accessory of claim 2, wherein said creasing rolls apply a crease of approximately 1.5 mm in width along the underside of incoming sheets.

4. The saddle stapler accessory of claim 3, wherein said stapler is cantileverly mounted over the apex of said roof-shaped tray.

5. The saddle stapler accessory of claim 4, including a passive anvil positioned opposite said stapler and adapted to work in conjunction with said stapler in order to stitch said booklets.

6. The saddle stapler accessory of claim 5, wherein said anvil is centrally located in and is an integral part of said roof-shaped tray.

7. The saddle stapler accessory of claim 6, wherein said paddle wheel is adapted for high speed rotation with a low normal force being presented to sheets leaving said creasing rolls.

8. The saddle stapler accessory of claim 7, wherein said creasing rolls include an idler roll with a deformable outer surface and a mating aluminum driving roll that is adapted to minimally deform the outer surface of said idler roll when creasing sheets.

9. The saddle stapler accessory of claim 8, wherein said baffles have a surface slanted at the same angle as said roof-shaped tray.

10. The saddle stapler of claim 9, wherein said compiler tray is angled downward from a horizontal plane in order to allow gravity to assist in registering sheets within said compiler tray.

11. A saddle stapler accessory for preparing booklets, comprising:

creasing means for applying a crease to sheets coming into said stapler accessory;

compiler means for receiving the sheets after they have been creased by said creasing means, said compiler means having a roof-shaped support surface with a portion of said support surface mating with the crease within the sheets;

baffle means positioned in relation to said support surface such that sheets leaving said creasing means are urged to conform to said support surface;

drive means for driving sheets into said compiler tray;

registration means for registering the sheets in first and second positions on said support surface;

control means for guiding the sheets onto and centering the sheets on said support surface of said compiler tray; and stapler means for saddle stitching the sheets as a set at said first and second registration position.

12. The saddle stapler accessory of claim 11, wherein said compiler tray is positioned at an angle away from a horizontal plane through said creasing means in order to allow gravity to assist in registering sheets at said first and second positions.

* * * * *